US006705113B2

(12) United States Patent
Wei et al.

(10) Patent No.: US 6,705,113 B2
(45) Date of Patent: Mar. 16, 2004

(54) OLEFIN PLANT REFRIGERATION SYSTEM

(75) Inventors: Vitus Tuan Wei, Houston, TX (US); Qi Ma, Katy, TX (US); James Tzong-Chaur Wu, Houston, TX (US); Charles Sumner, Livingston, NJ (US)

(73) Assignee: ABB Lummus Global Inc., Bloomfield, NJ (US)

( * ) Notice: Subject to any disclaimer, the term of this patent is extended or adjusted under 35 U.S.C. 154(b) by 0 days.

(21) Appl. No.: 10/342,998

(22) Filed: Jan. 15, 2003

(65) Prior Publication Data

US 2003/0192342 A1 Oct. 16, 2003

Related U.S. Application Data

(63) Continuation-in-part of application No. 10/121,151, filed on Apr. 11, 2002.

(51) Int. Cl.[7] ..... F25J 1/00
(52) U.S. Cl. ..... 62/612; 62/620; 62/913
(58) Field of Search ..... 62/612, 620, 913

(56) References Cited

U.S. PATENT DOCUMENTS 3,855,810 A * 12/1974 Simon et al. ..... 62/612
4,094,655 A * 6/1978 Krieger ..... 62/612
RE30,085 E * 8/1979 Perret ..... 62/612
4,251,247 A * 2/1981 Gauberthier et al. ..... 62/612
5,613,373 A 3/1997 Grenier ..... 62/612
5,979,177 A * 11/1999 Sumner et al. ..... 62/612
6,334,334 B1 * 1/2002 Stockmann et al. ..... 62/612

* cited by examiner

*Primary Examiner*—William C. Doerrler
(74) *Attorney, Agent, or Firm*—Alix, Yale & Ristas, LLP

(57) ABSTRACT

The refrigeration system for an ethylene plant comprises a closed loop tertiary refrigerant system containing methane, ethylene and propylene. The tertiary refrigerant from a compressor final discharge is separated into a methane-rich vapor fraction and two levels of propylene-rich liquids so as to provide various temperatures and levels of refrigeration in various heat exchange stages while maintaining a nearly constant refrigerant composition flowing back to the compressor and with the bulk of the total return refrigerant flow going to the first stage compressor section. This tertiary system can also be applied to an ethylene plant with a high pressure demethanizer.

8 Claims, 1 Drawing Sheet

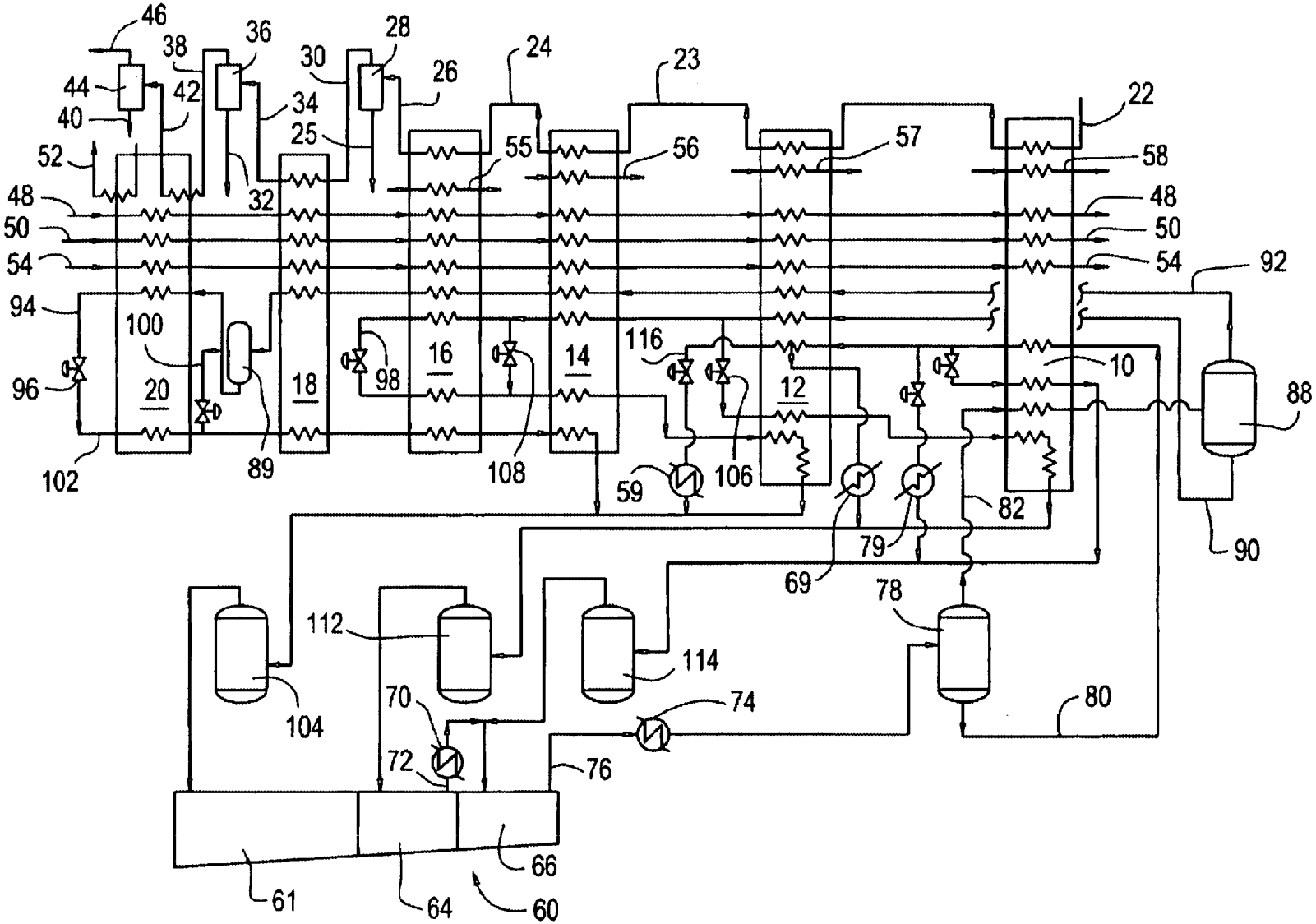
88
92
90
22
58
48
50
54
10
80
82
78
79
69
57
12
106
74
114
23
56
116
59
76
14
66
60
24
55
108
26
16
64
28
98
70
72
30
34
25
18
112
104
36
32
89
61
38
42
100
20
46
44
40
52
48
50
54
94
96
102

OLEFIN PLANT REFRIGERATION SYSTEM

This application is a continuation-in-part of application Ser. No. 10/121,151, filed Apr. 11, 2002.

BACKGROUND OF THE INVENTION

The present invention pertains to a refrigeration system to provide the cooling requirements of an olefin plant. More particularly, the invention is directed to the use of a tertiary or trinary refrigerant comprising a mixture of methane, ethylene and propylene for cooling in an ethylene plant.

Ethylene plants require refrigeration to separate out desired products from the cracking heater effluent. Typically, a propylene and an ethylene refrigerant are used. Often, particularly in systems using low pressure demethanizers where lower temperatures are required, a separate methane refrigeration system is also employed. Thus three separate refrigeration systems are required, cascading from lowest temperature to highest. Three compressor and driver systems complete with suction drums, separate exchangers, piping, etc. are required. An additional methane refrigeration compressor, either reciprocating or centrifugal, can partially offset the capital cost savings resulting from the use of low pressure demethanizers.

Mixed refrigerant systems have been well known in the industry for many decades. In these systems, multiple refrigerants are utilized in a single refrigeration system to provide refrigeration covering a wider range of temperatures, enabling one mixed refrigeration system to replace multiple pure component cascade refrigeration systems. These mixed refrigeration systems have found widespread use in base load liquid natural gas plants. The application of a binary mixed refrigeration system to ethylene plant design is disclosed in U.S. Pat. No. 5,979,177 in which the refrigerant is a mixture of methane and either ethylene or ethane. However, such a binary refrigeration system cascades against a separate propylene refrigeration system which provides the refrigeration in the temperature range of −40° C. and warmer. Therefore, two separate refrigeration systems are required.

SUMMARY OF THE INVENTION

It is an object of the present invention, therefore, to provide a simplified, single refrigeration system for an olefin plant, particularly an ethylene plant having a low pressure demethanizer, utilizing a mixture of methane, ethylene and propylene as a tertiary refrigerant. This tertiary system replaces the separate propylene, ethylene and methane refrigeration systems associated with a recovery process using a low pressure demethanizer. The invention involves the separation of the tertiary refrigerant from the discharge of the final stage of a compressor into a methane-rich vapor fraction and two levels of propylene-rich liquids so as to provide various temperatures and levels of refrigeration in various heat exchange stages while maintaining a nearly constant refrigerant composition, as measured by molecular weight, in the compressor and with the bulk of the total return refrigerant flow going to the first stage compressor suction. This enables the tertiary refrigerant system to compete favorably on a thermodynamic basis with the use of separate compressors for separate refrigerants. This tertiary system can also be applied to an ethylene plant with a high pressure demethanizer in which case the tertiary system only supplies propylene and ethylene refrigeration temperature levels. The objects, arrangement and advantages of the refrigeration system of the present invention will be apparent from the description which follows.

BRIEF DESCRIPTION OF THE DRAWING

The drawing is a schematic flow diagram of a portion of an ethylene plant illustrating one embodiment of the refrigeration system of the present invention.

DESCRIPTION OF THE PREFERRED EMBODIMENTS

The present invention relates to an olefin plant wherein a pyrolysis gas is first processed to remove methane and hydrogen and then processed in a known manner to produce and separate ethylene as well as propylene and some other by-products. The process will be described in connection with a plant which is primarily for the production of ethylene. The separation of the gases in an ethylene plant through condensation and fractionation at cryogenic temperatures requires refrigeration over a wide temperature range. The capital cost involved in the refrigeration system of an ethylene plant can be a significant part of the overall plant cost. Therefore, capital savings for the refrigeration system will significantly affect the overall plant cost.

Ethylene plants with high pressure demethanizers operate at pressures higher than 2.76 MPa (400 psi) with an overhead temperature typically in the range of −85° C. to −100° C. Ethylene refrigeration at approximately −100° C. to −102° C. is typically used to chill and produce overhead reflux. An ethylene plant designed with a low pressure demethanizer which operates below about 2.41 MPa (350 psi) and generally in the range of 0.345 to 1.034 MPa (50 to 150 psi) and with overhead temperatures in the range of −110° C. to −140° C. requires methane temperature levels of refrigeration to generate reflux. The advantage of the low pressure demethanizer is the lower total plant power requirement and the lower total plant capital cost while the disadvantage is the lower refrigeration temperature required and, therefore, the need for a methane refrigeration system in addition to the ethylene and propylene refrigeration systems.

The tertiary refrigerant of the present invention comprises a mixture of methane, ethylene and propylene. The percentage of these components can vary depending on the ethylene plant cracking feedstock, the cracking severity and the chilling train pressure among other considerations, but will generally be in the range of 7 to 20 mol percent methane, 7 to 20 mol percent ethylene and 50 to 90 mol percent propylene as measured at the compressor discharge. A typical composition for an ethylene plant with a low pressure demethanizer would be 10% methane, 10% ethylene and 80% propylene. The use of the tertiary refrigerant provides all the refrigeration loads and temperatures required for an ethylene plant while obviating the need for two or three separate refrigerant systems.

The purpose of the present invention is to provide the necessary refrigeration to separate the hydrogen and methane from the charge gas and provide the feed for the demethanizer as well as provide for the other refrigeration requirements of the entire plant. Referring to the specific embodiment of the invention shown in the drawing which is for a low pressure demethanizer, the tertiary refrigeration system is arranged to provide all of the required levels of refrigeration for an ethylene plant in the series of heat exchangers 10, 12, 14, 16, 18 and 20. These heat exchangers can be combined as fewer units or expanded into a greater number of units depending on the particular needs for any particular ethylene process and in particular on the specific charge gas composition. They are typically plate fin type heat exchangers and are preferably packed inside of a heavily insulated structure referred to as a cold box to prevent heat gain and to localize the low temperature operation. Before describing the tertiary refrigeration system, the flow of the charge gas through the system will be described with examples of specific temperatures for purposes of illustration only.

The charge gas feed 22, which is the pyrolysis gas conditioned as required and cooled, is typically at a temperature of about 15° C. to 20° C. and a pressure of about 3.45 MPa (500 psi), and is typically a vapor stream. The charge gas contains hydrogen, methane, and $C_2$ and heavier components including ethylene and propylene. The charge gas 22 is progressively cooled by the refrigeration system of the present invention in the heat exchangers 10, 12, 14, 16, 18 and 20 with appropriate separations being made to produce demethanizer feeds. The charge gas 22 is first cooled in the heat exchangers 10 and 12 down to about −35° C. at 23. In heat exchanger 14, the charge gas is cooled from −35° C. to −60° C. at 24. In heat exchanger 16, it is cooled from −60° C. to −72° C. with the condensate 25 in the effluent 26 being separated at 28. The condensate 25 is a lower feed to the demethanizer (not shown). The remaining vapor 30 is then cooled from −72° C. to −98° C. in heat exchanger 18 with the condensate 32 in the effluent 34 being separated at 36. This condensate 32 is a middle feed to the demethanizer. The vapor 38 is then further cooled in heat exchanger 20 from −98° C. to −130° C. with the condensate 40 in the effluent 42 being separated at 44. The condensate 40 is a top feed to the demethanizer. The remaining vapor 46 is then separated (not shown) to produce the hydrogen stream 48 and the low pressure methane stream 50. The cooling loop 52 in heat exchanger 20 is for cooling and partially condensing the low pressure demethanizer overhead to generate reflux. The remaining overhead vapor from the demethanizer forms the high pressure methane stream 54. The hydrogen stream 48 and the low and high pressure methane streams 50 and 54 provide additional cooling in the heat exchangers. To complete the description of the charge gas flow, it is the demethanizer bottoms which contains the $C_2$ and heavier components which is sent for the recovery of the ethylene and propylene and other components.

In addition to the charge gas stream and the tertiary refrigerant streams, the streams 55, 56, 57 and 58 are various ethylene plant streams at various temperatures which also pass through the heat exchangers for recuperation of cold. Merely as examples, stream 55 is for the recuperation of the cold from the low pressure demethanizer side reboiler. Stream 56 recuperates the cold from the demethanizer feed and the low pressure demethanizer bottom reboiler. Stream 57 is for recuperation of the demethanizer feed, the ethane recycle, the ethylene fractionator side reboiler and bottom reboiler and the ethylene product. The last stream 58 covers the recuperation of cold from the lower deethanizer feed, the ethylene product and the ethane recycle.

The maximum efficiency of heat transfer between a warm fluid and a cold fluid is achieved when the temperature difference is low. A mixed refrigerant, such as proposed in this invention, has an increasing temperature with increasing vaporization, at a fixed pressure. This is as distinguished from a pure component refrigerant which vaporizes at a constant temperature at a fixed pressure. Pure component refrigeration systems therefore tend to be more efficient when the process condensing temperatures are unchanged, or relatively unchanged, when being cooled, and relatively less efficient when process temperatures decrease when being cooled. For mixed refrigeration systems, such as proposed in this invention, the relative advantages are reversed.

In an ethylene plant, some of the cooling services requiring refrigeration are at relatively constant temperatures and some are at decreasing temperatures. In the pending U.S. patent application Ser. No. 09/862,253, entitled, Tertiary Refrigeration System for Ethylene Plants, and filed May 22, 2001, a mixed refrigerant system for ethylene plants is described which emphasizes a constant composition throughout the system. Thus, a somewhat lower efficiency in the constant temperature heat transfer services has been understood. The present invention proposes to improve the efficiency of the mixed refrigeration system by varying the composition of the mixed refrigerant used for these constant temperature heat transfer services. This invention is especially directed to the refrigeration system utilized in the separation of ethylene from ethane which has a very large refrigeration requirement. The concept can also be utilized for other constant temperature heat transfer services with lower heat transfer duty such as the deethanizer.

For the purposes of the present invention, the total duty of the ethylene fractionator condenser 59, the total duty of the deethanizer condenser 69 and the total duty of the low pressure depropanizer condenser 79 are handled outside the coldbox with special consideration. As known from the thermodynamics, the condensation of the process stream with constant temperature, such as the ethylene fractionator overhead and the deethanizer overhead, as well as the depropanizer overhead if a single low pressure tower is employed, will be less efficient if a mixed refrigeration system is used where the vaporization curve is sloped with temperature. The wide cold-end temperature approach indicates inefficiency and results in higher power consumption for the tertiary refrigeration system. To make the tertiary system competitive in power consumption to a system designed with separate compressors, a concept to generate a heavy refrigerant stream approaching the conventional propylene refrigeration is called for in the tertiary system of the present invention. In the present invention, the composition of stream 80, which supplies the refrigeration normally supplied by a separate propylene compressor, is typically greater than 80 mol percent propylene.

Turning now to the refrigeration system per se, the tertiary refrigerant as identified earlier is a mixture of methane, ethylene and propylene and is compressed by the multistage refrigeration compressor 60. In the illustrated embodiment, there are three compressor stages 61, 64, and 66 with one interstage coolers. The interstage cooler 70 is at the second stage discharge. The final discharge 76 is partially condensed in discharge cooler 74 by cooling water and then separated in the drum 78 to provide the heavy liquid refrigerant 80. The remaining vapor 82 from drum 78 is cooled in exchanger 10 by heavy refrigerant from drum 78 and partially condensed and then separated in drum 88 to generate a medium liquid refrigerant 90 and a light vapor refrigerant 92 by phase separation. The light vapor refrigerant generated from drum 88 is cooled in exchanger 12, 14 and 16 by medium liquid refrigerant and then condensed in exchanger 18 by self-refrigeration. The typical operating conditions and the range of operating conditions for the compressor are as follows:

| | Range of Suction Pressure | Typical Suction Conditions | |
|---|---|---|---|
| | MPa | MPa | Degree C. |
| 1st Stage | 0.011–0.016 | 0.014 | −40 |
| 2nd Stage | 0.40–0.55 | 0.50 | −10 |
| 3rd Stage | 0.90–1.40 | 1.20 | 30 |

The light refrigerant 92 from the drum 88 passes through the heat exchangers 12 to 18 and is condensed and sent to light refrigerant drum 89. It is then subcooled to about −130° C. at the exit 94 from heat exchanger 20 and then flashed through valve 96 to provide the lowest refrigeration temperature of −140° C. to −145° C. This level of refrigeration provides the cooling of the charge gas stream at 42 down to −130° C. or lower and to provide sufficient cooling in the loop 52 to generate reflux from the demethanizer overhead.

The charge gas temperature in stream 34 is typically at −98° C. by controlling the flow of the light refrigerant in stream 100. Typically, the refrigeration supplied by the stream 102 will meet the refrigeration demand in heat exchangers 20, and 18. The light refrigerant is finally superheated to about −45° C. in heat exchanger 14. This provides the desired superheat temperature of 5 to 15° C. when it is mixed with portions of the heavy and medium refrigerate streams for return to the first stage suction drum 104.

The liquid 90 from the drum 88 is the medium refrigerant which is subcooled as it passes through heat exchangers 12, 14 and 16. This medium refrigerant controls the temperature of the charge gas at 24 and 26 by flashing the subcooled refrigerant through valves 98 and 108. From valve 98 and 108, the medium refrigerant flows back through heat exchangers 16, 14 and 12 and then to the suction drum 104 for the first stage 61 of the compressor. From valve 106, the medium refrigerant flows back through heat exchangers 12 and 10 and then to the suction drum 112 for the second stage 64 of the compressor. The heavy refrigerant 80 from the drum 78 is about 88% propylene. This liquid supplies four major duties, i.e., the cooling for the ethylene fractionator condenser 59, the cooling for the deethanizer condenser 69, the cooling for the low pressure depropanizer condenser 79 and the major refrigeration demand in heat exchanger 10 to support the self-refrigeration of the tertiary refrigeration system. The degrees of subcooling of the heavy refrigerant exiting the heat exchanger 12 are flexible between −10° C. and −35° C. The following table is a summary of the suction streams to the compressor and the compressor flows.

| Stages | Type of Refrigerant | Wt % of total flow | Ave. MW |
|---|---|---|---|
| 1st Stage Suction | 100% Light Refrigerant | 10.0 | |
| | Medium Refrigerant | 5.0 | |
| | Heavy Refrigerant | 60.0 | |
| 1st Stage Flow | | 75.0 | 38.1 |
| 2nd Stage Side Inlet | Medium & Heavy Refrigerant | 10.0 | |
| 2nd Stage Flow | | 85.0 | 38.2 |
| 3rd Stage Side Inlet | Heavy Refrigerant | 15.0 | |
| 3rd Stage Flow | | 100 | 38.6 |

As shown by the above table, the split of the refrigerant for the purpose of energy saving and then the recombination of the refrigerants, particularly the recombination in the first compressor stage of the light and most of the heavy refrigerants along with some medium refrigerant to provide almost 75% of the total flow in the first stage stabilizes the compressor wheels. With 75% of the total flow in the first stage and a relatively uniform molecular weight throughout preferably varying less than 5% and most preferably varying less than 2%, a normal speed control of the turbine by the first stage suction drum pressure becomes equally applicable to the tertiary refrigerant compressor system as to a single refrigerant compressor system. With respect to the control of the process chilling duties, the variables which can be used include the control of the critical temperature, the adjustment of the overall refrigerant composition, the adjustment of the temperatures in the separation drums 78 and 88 and the adjustment of the compressor operating conditions.

The closed loop tertiary refrigeration system with three or more inter-stages of the present invention provides a versatile system in which various refrigerant compositions can be formed and various refrigeration levels can be provided. This provides precise temperature control in an efficient and economical manner. Therefore, a single closed loop tertiary refrigeration system can adequately provide all the necessary refrigeration to the entire ethylene plant with either a low pressure or high pressure demethanizer at a competitive power consumption and a lower overall plant cost.

What is claimed is:

1. In a process for the production of olefins from a charge gas containing hydrogen, methane, ethylene and other $C_2$ and heavier hydrocarbons wherein said charge gas and additional olefin plant process streams are cooled by a refrigeration system having a series of heat exchangers, a method for cooling said charge gas and additional olefin plant process streams by the use of a tertiary refrigerant in said refrigeration system comprising the steps of:

(a) compressing a tertiary refrigerant vapor comprising a selected mixture of methane, ethylene and propylene in a multistage compressor having a first stage, at least one intermediate stage and a last stage with a last stage discharge wherein the composition of said last stage discharge is greater than 50 mol percent propylene;

(b) cooling to condense a portion of said tertiary refrigerant vapor from said last stage discharge to form a remaining tertiary refrigerant vapor and a heavy liquid refrigerant having a greater percentage of propylene than said selected mixture;

(c) separating said heavy liquid refrigerant from said remaining tertiary refrigerant vapor in a separator;

(d) cooling to condense at least a portion of said remaining tertiary refrigerant vapor from said separator and thereby forming a medium liquid refrigerant and forming a light vapor refrigerant of any uncondensed portion thereof;

(e) bringing said heavy and medium liquid refrigerants and any light vapor refrigerant into heat exchange contact with themselves and each other and with said charge gas and additional olefin plant process streams in said series of heat exchangers whereby said charge gas and additional olefin plant process streams are cooled and said heavy and medium liquid refrigerants are subcooled and then heated and vaporized and said light vapor refrigerant is first cooled and condensed and then vaporized; and (f) returning said light and medium and heavy vaporized refrigerants to said compressor.

2. In a process as recited in claim 1 wherein said step of cooling to condense a portion of said tertiary refrigerant vapor comprises the step of cooling with cooling water.

3. In a process as recited in claim 2 wherein said medium liquid refrigerant and said light vapor refrigerant are formed by partially condensing said uncondensed vapor using said heavy liquid refrigerant.

4. In a process as recited in claim 2 wherein said light vapor refrigerant is partially condensed by said medium liquid refrigerant and fully condensed through self-refrigeration by said light vapor refrigerant.

5. In a process as recited in claim 1 further including the step of using said heavy vaporized refrigerant for cooling one or more of an ethylene fractionator, a deethanizer condenser and a depropanizer condenser.

6. In a process as recited in claim 1 wherein the composition of said heavy liquid refrigerant is greater than 80 mol percent propylene.

7. In a process as recited in claim 1 wherein the molecular weight variation in said compressor stages is less than 5%.

8. In a process as recited in claim 1 wherein the molecular weight variation in said compressor stages is less than 2%.

* * * * *